US008401922B2

(12) United States Patent
Roberts

(10) Patent No.: US 8,401,922 B2
(45) Date of Patent: Mar. 19, 2013

(54) METHOD, MEDIUM, AND SYSTEM FOR MANAGING LINKED AUCTIONS

(75) Inventor: Mark E. Roberts, Santa Monica, CA (US)

(73) Assignee: Ubungee Inc., Santa Monica, CA (US)

( * ) Notice: Subject to any disclaimer, the term of this patent is extended or adjusted under 35 U.S.C. 154(b) by 99 days.

(21) Appl. No.: 12/901,314

(22) Filed: Oct. 8, 2010

(65) Prior Publication Data

US 2011/0087554 A1 Apr. 14, 2011

Related U.S. Application Data

(60) Provisional application No. 61/250,243, filed on Oct. 9, 2009.

(51) Int. Cl.
*G06Q 30/00* (2012.01)

(52) U.S. Cl. ..... 705/26.3; 705/37

(58) Field of Classification Search ..... 705/26.3, 705/37

See application file for complete search history.

(56) References Cited

U.S. PATENT DOCUMENTS

| | | | | |
|---|---|---|---|---|
| 6,598,026 | B1 * | 7/2003 | Ojha et al. | 705/80 |
| 6,963,854 | B1 * | 11/2005 | Boyd et al. | 705/37 |
| 7,024,376 | B1 * | 4/2006 | Yuen | 705/26.3 |
| 7,058,602 | B1 * | 6/2006 | La Mura et al. | 705/37 |
| 7,107,268 | B1 * | 9/2006 | Zawadzki et al. | 1/1 |
| 7,124,107 | B1 * | 10/2006 | Pishevar et al. | 705/37 |
| 7,133,835 | B1 * | 11/2006 | Fusz et al. | 705/26.3 |
| 7,480,627 | B1 * | 1/2009 | Van Horn et al. | 705/26.2 |
| 7,698,190 | B2 * | 4/2010 | Penkalski et al. | 705/35 |
| 2001/0032162 | A1 * | 10/2001 | Alsberg et al. | 705/37 |
| 2002/0077954 | A1 * | 6/2002 | Slaight et al. | 705/37 |
| 2002/0143692 | A1 * | 10/2002 | Heimermann et al. | 705/37 |
| 2002/0147674 | A1 * | 10/2002 | Gillman | 705/37 |
| 2002/0165817 | A1 * | 11/2002 | Rackson et al. | 705/37 |
| 2003/0004850 | A1 * | 1/2003 | Li et al. | 705/37 |

(Continued)

OTHER PUBLICATIONS

Dong-Her Shih, A new reverse auction agent system for m-commerce using mobile agents, Computer Standards & Interfaces, vol. 27, Issue 4, Apr. 2005, pp. 383-395, ISSN 0920-5489.*

(Continued)

*Primary Examiner* — Matthew Zimmerman

(57) ABSTRACT

A system, a method, an apparatus, and a computer program product are provided. The apparatus includes at least one memory including computer program code, and at least one processor. The at least one memory and the computer program code are configured to, with the at least one processor, cause the apparatus at least to receive a request from a first user node to initiate an auction for a purchase of a product, and initiate an auction for the product. The at least one memory and the computer program code are also configured to, with the at least one processor, cause the apparatus at least to receive an initial bid from a second user node. The initial bid includes a price term that is lower than or equal to an initial price term for the product. The at least one memory and the computer program code are also configured to, with the at least one processor, cause the apparatus at least to receive one or more subsequent bids from the second user node or another user node. Each subsequent bid includes a price term that is lower than the price term of the initial bid and all preceding subsequent bids. Furthermore, the at least one memory and the computer program code are configured to, with the at least one processor, cause the apparatus at least to terminate the auction, when a period of time lapses or a price point is accepted.

9 Claims, 18 Drawing Sheets

U.S. PATENT DOCUMENTS

| | | | | |
|---|---|---|---|---|
| 2003/0023687 | A1* | 1/2003 | Wolfe | 709/206 |
| 2003/0041014 | A1* | 2/2003 | Grey et al. | 705/37 |
| 2003/0220773 | A1* | 11/2003 | Haas et al. | 703/2 |
| 2007/0136179 | A1* | 6/2007 | Nguyen | 705/37 |
| 2007/0174171 | A1* | 7/2007 | Sheffield | 705/37 |
| 2007/0208630 | A1* | 9/2007 | Chatter et al. | 705/26 |
| 2009/0222352 | A1 | 9/2009 | Shaer | |

OTHER PUBLICATIONS

International Search Report application No. PCT/US 10/52078 filed Oct. 8, 2010.

* cited by examiner

FIG. 3C

Product Description

With Magic Mouse, Apple has brought Multi-Touch technology to the desktop mouse, giving you a new and more intuitive way to interact with your computer. Just as with iPhone, iPod touch, and MacBook Pro, the Bluetooth Magic Mouse adds gestures and swipes to the usual clicks to bring more functionality and help you get more done with less effort.

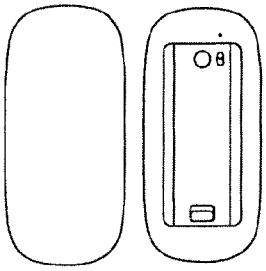

Beautiful Design with Seamless Multi-Touch Surface

One look at Magic Mouse and you'll know it's something special that only Apple could dream up. With a low-profile design and seamless top shell, you'll marvel at this beautiful mouse and its smooth, buttonless appearance.

It's not all looks, though. Once you touch it, you'll appreciate how good it feels in your hand. And the magic really begins when you start using it. The Multi-Touch surface covers the entire top of the mouse, and the mouse itself is the button. Scroll in any direction with one finger, swipe through web pages and photos with two, and click and double-click anywhere. Inside Magic Mouse is a chip that tells it exactly what you want to do. Which means Magic Mouse won't confuse a scroll with a swipe. It even knows when you're just resting your hand on it.

Laser-Tracking Engine

Magic Mouse uses powerful laser tracking that's far more sensitive and responsive on more surfaces than traditional optical tracking. That means it tracks with precision on nearly every surface - whether it's a table at your favorite cafe or the desk in your home office - without the need for a mousepad.

Wireless Convenience with Easy Bluetooth Setup

Magic Mouse connects wirelessly to your Mac via Bluetooth, so there's no wire or separate adapter to worry about. Pair Magic Mouse with your Bluetooth-enabled Mac and enjoy a reliable and secure connection up to 33 feet away. When you combine Magic Mouse with the Apple Wireless Keyboard, you create a workspace free of annoying cables.

And because Magic Mouse is wireless, it can venture beyond the confines of your desk. A quick flick of the on/off switch helps conserve battery power while Magic Mouse is tucked in your bag. Even when it's on, Magic Mouse manages power efficiently, by detecting periods of inactivity automatically.

FIG. 3D

Make One Great Gesture After Another

Multi-Touch technology on the iPhone and iPod touch introduced a breakthrough way to interact with your content. Magic Mouse, with its Multi-Touch surface, does the same thing for your Mac. When you use gestures, it's as if you're touching what's on your screen. For instance, swiping through web pages in Safari gives you the feeling of flicking through pages in a magazine. And scrolling with Magic Mouse isn't your everyday scrolling. It supports momentum scrolling (similar to iPhone and iPod touch), where the scrolling speed is dictated by how fast or slowly you perform the gesture.

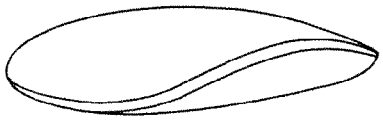

Give it Your Personal Touch

Maybe you want scrolling but don't want swiping. Or two-button clicking instead of one. Whatever the case, Magic Mouse works the way you want it to work. All you do is go to the Magic Mouse preference pane in System Preferences to enable or disable features.

The ambidextrous design of Magic Mouse means it fits comfortably in your right hand if you're a righty or in your left hand if you're a lefty. And left-handers can easily swap left and right button functionality using System Preferences.

System Requirements

Bluetooth-enabled Mac computer
Mac OS X v10.5.8 or later with Wireless Mouse Software Update 1.0
Existing keyboard and mouse for setup

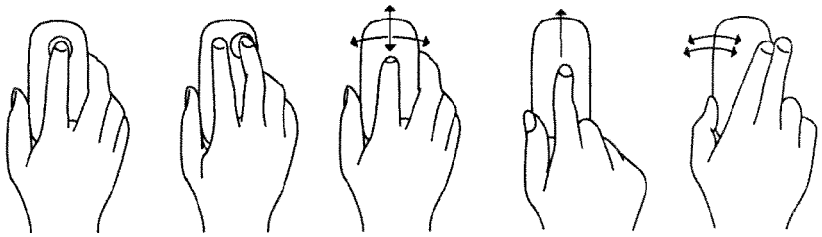

Product Description

It began with iPhone. Then came iPod touch. Then MacBook Pro. Intuitive, smart, dynamic. Multi-Touch technology introduced a remarkably better way to interact with your portable devices - all using gestures. Now we've reached another milestone by bringing gestures to the desktop with a mouse that's unlike anything ever before. It's called Magic Mouse. It's the world's first Multi-Touch mouse. And while it comes standard with every new iMac, you can also add it to any Bluetooth-enabled Mac for a Multi-Touch makeover.

Home | FAQ | About Us | uBungee in the News

FIG.5A bungee home | sign up | login cart | wishlist browse by dept ▽ | all categories ▽

Summary

Summary (21) | Current (9) | Rebuyable (34) | Jumpball (12) | Purchase History (217)

SUMMARY VIEW - This is a quick overview of your Auction Activity -- Past, Present, and Future!

Current Auctions

| Title | Time Left | # of Bids | Leading Bid | Your Lowest Bid | | Actions |
|---|---|---|---|---|---|---|
| Drive Electronics | 6 Hrs : 25 Mins : 06 Secs | 15 | $310.7 | $320.5 | | Submit Bid / View Auction |
| Drive Electronics Department | 6 Hrs : 25 Mins : 06 Secs | 10 | $310.7 | $320.5 | | Submit Bid / View Auction |
| Drive Electronics Department and Some Other Words Also | 6 Hrs : 25 Mins : 06 Secs | 15 | $310.7 | $320.5 | | Submit Bid / View Auction |
| Drive Electronics Department | 6 Hrs : 25 Mins : 06 Secs | 10 | $310.7 | $320.5 | | Submit Bid / View Auction |

Rebuy Requests

| Title | Winning Bid | Buyer | Expires In | Actions |
|---|---|---|---|---|
| Drive Electronics | $99.7 | Peter's Electronics | 9 Hrs : 7 Mins : 5 Secs | View / Accept / Reject |
| Drive Electronics Department | $299.7 | ABC Warehouse | 9 Hrs : 7 Mins : 5 Secs | View / Accept / Reject |
| Drive Electronics Department and Some Other Words Also | $99.7 | Walton Appliance | 9 Hrs : 7 Mins : 5 Secs | View / Accept / Reject |

Jumpball Auctions

Jumpballs Present and Past

| Title | Winning Bid | Buyer | Time Left | Status |
|---|---|---|---|---|
| Drive Electronics | $99.7 | Mark | 6 Hrs : 32 Mins : 12 Secs | Pending |
| Drive Electronics Department | $299.7 | Sarp | Accepted! | Accepted! |
| Drive Electronics Department and Some Other Words Also | $99.7 | Yasemin | Expired | Expired |

Future Jumpballs (Available to Offer)

| Title | Winning Bid | Buyer | Expires In | Offer the Jumpball? |
|---|---|---|---|---|
| Drive Electronics Department | $299.7 | Mark | 6 Hrs : 32 Mins : 12 Secs | Yes No |
| Drive Electronics Department | $299.7 | Sarp | 3 Hrs : 29 Mins : 6 Secs | Yes No |
| Drive Electronics Department | $299.7 | Yasemin | Expired | |

Sales History

| Title | Winning Bid | Buyer | Started | Ended | Actions |
|---|---|---|---|---|---|
| Drive Electronics | $99.7 | Mark | Aug 15, 2010 11:05 pm PDT | Aug 18, 2010 11:05 pm PDT | Leave Feedback Offer Jumpball Delete |
| Drive Electronics Department | $299.7 | Sarp | Aug 15, 2010 11:05 pm PDT | Aug 18, 2010 11:05 pm PDT | Leave Feedback Offer Jumpball Delete |
| Drive Electronics Department and Some Other Words Also | $99.7 | Yasemin | Aug 15, 2010 11:05 pm PDT | Aug 18, 2010 11:05 pm PDT | Leave Feedback Offer Jumpball Delete |

Home | FAQ | About Us | uBungee in the News

FIG.5B

No Records Found

| Event | Date | Days Until | Reminder | Frequency | Actions |
|---|---|---|---|---|---|
| markb4's 08/04-1 week NO REM test | 08/11/2010 | 6 | No Reminder ∇ | every year | Edit Delete |
| **markb4's 08/04-1 week rem test** | **08/11/2010** | **6** | **1 Week ∇** | **every year** | **Edit Delete** |
| markb4's 08/04-2 week rem test | 08/18/2010 | 13 | 2 Weeks ∇ | once only | Edit Delete |
| **markb4's 08/04-1 month rem test** | **09/04/2010** | **30** | **1 Month ∇** | **every year** | **Edit Delete** |
| markb4's 08/04-2 month rem test | 10/04/2010 | 60 | 2 Months ∇ | once only | Edit Delete |

Close Add Event

| Event | Date | Reminder | Frequency |
|---|---|---|---|
| | | Select ∇ | Select ∇ |

Save Cancel

FIG.6B

We didn't recognize your entry as a valid UPC format (Please format like: 821793005788)

Received: Thurs July 29, 2010 1:33 PM PST 8 21793 00578 8

Sent: Thurs July 29, 2010 1:33 PM PST

Please Enter a UPC barcode. We can currently recognize many 12 and 13 digit barcodes.

Received: Thurs July 29, 2010 1:33 PM PST

1

Sent: Thurs July 29, 2010 1:33 PM PST

Where to:
(1)EnterUPC#
(2)ViewWishList
(3)CurrentAuctions
(4)myHistory
(5)KeywordSearch
(6)myRecentSearches
(7)myFriends Received: Thurs July 29, 2010 1:33 PM PST menu Sent: Thurs July 29, 2010 1:33 PM PST Home | FAQ | About Us | uBungee in the News

FIG.10B

METHOD, MEDIUM, AND SYSTEM FOR MANAGING LINKED AUCTIONS

CROSS REFERENCE TO RELATED APPLICATIONS

This application claims priority under 35 U.S.C. §119(e) of U.S. Provisional Patent Application Ser. No. 61/250,243, filed Oct. 9, 2009. The subject matter of the earlier filed application is hereby incorporated by reference.

BACKGROUND

1. Field

Embodiments of the invention relate to a system and method for conducting an auction over the Internet. More specifically, certain embodiments of the invention are directed to a system, an apparatus, a method, and a computer program product for conducting an auction over the Internet to enable a buyer to purchase products at a price determined by reverse bidding of a seller or sellers.

2. Description of the Related Art

Traditional auctions have been around for centuries, while Internet-based auctions have existed for well over a decade. During this relatively short period of time, a small number of Internet-based platforms have grown to dominate the auction marketplace space that is extremely valuable. Even though there is, and will continue to be, incredible monetary and physical product exchange through the traditional Internet auction model, this model is often complex (i.e., it is multi-touch), and therefore does not transition well to the emerging mobile marketplace. Thus, conventional Internet-based auctions leave significant room for innovation and business/platform modifications that could ultimately attract a whole new segment of bargain-hunting shoppers via, not only the Internet, but more uniquely through a mobile device, such as the mobile phone or a handheld computer.

Buyers seeking to find a bargain increasingly use the Internet-based auction to make purchases for goods and services (hereinafter referred to as a "product" or "products"). Buyers spend a considerable amount of time searching through information (i.e., that is seldom useful information) to "mine" for the next deal through a coupon, discount or rebate. Buyers also frequently expend time, energy and resources waiting for a sale to appear on a particular item of interest or try their luck in a typical auction environment where they must bid against other interested buyers to "win" the right to purchase the product from the seller.

In addition to offering direct discounts to buyers, sellers often pay information distributors and content providers to deliver messages and money-saving mechanisms to buyers with the hope of minimizing the time, energy and resources required to identify and market the interested buyer or buyers for the sellers' products. However, even with these marketing tools, sellers often realize that it is a challenge to locate willing buyers to purchase their products, and therefore difficult to justify the amount of marketing dollars spent against sales obtained from these marketing efforts.

SUMMARY

In accordance with an embodiment of the invention, there is provided an apparatus, which includes at least one memory including computer program code, and at least one processor. The at least one memory and the computer program code are configured to, with the at least one processor, cause the apparatus at least to receive a request from a first user node to initiate an auction for a purchase of a product, and initiate an auction for the product. The at least one memory and the computer program code are also configured to, with the at least one processor, cause the apparatus at least to receive an initial bid from a second user node. The initial bid includes a price term that is lower than or equal to an initial price term for the product. The at least one memory and the computer program code are also configured to, with the at least one processor, cause the apparatus at least to receive one or more subsequent bids from the second user node or another user node. Each subsequent bid includes a price term that is lower than the price term of the initial bid and all preceding subsequent bids. Furthermore, the at least one memory and the computer program code are configured to, with the at least one processor, cause the apparatus at least to terminate the auction, when a period of time lapses or a price point is accepted.

In accordance with another embodiment of the invention, there is provided a method, which includes instructions to control a processor to perform a process, which includes receiving a request from a first user node to initiate an auction for a purchase of a product, and initiating an auction for the product. The method further includes receiving an initial bid from a second user node. The initial bid includes a price term that is lower than or equal to an initial price term for the product. The method further includes receiving one or more subsequent bids from the second user node or another user node. Each subsequent bid includes a price term that is lower than the price term of the initial bid and a preceding subsequent bid. Furthermore, the method includes terminating the auction, when a period of time lapses or a price point is accepted.

In accordance with another embodiment of the invention, there is provided a computer program product embodied on a non-transitory computer readable medium. The computer program product is encoded with instructions to control a processor to perform a process, which includes receiving a request from a first user node to initiate an auction for a purchase of a product, and initiating an auction for the product. The process further includes receiving an initial bid from a second user node. The initial bid includes a price term that is lower than or equal to an initial price term for the product. The process further includes receiving one or more subsequent bids from the second user node or another user node. Each subsequent bid includes a price term that is lower than the price term of the initial bid and a preceding subsequent bid. Furthermore, the process includes terminating the auction, when a period of time lapses or a price point is accepted.

BRIEF DESCRIPTION OF THE DRAWINGS

Further aspects, details, advantages and modifications of the invention will become apparent from the following detailed description of the embodiments, which is to be taken in conjunction with the accompanying drawings, in which:

FIG. 5 is an auction activity view of a graphical user interface of a user node, in accordance with an embodiment of the invention.

DETAILED DESCRIPTION OF THE PREFERRED EMBODIMENTS

It will be readily understood that the components of the invention, as generally described and illustrated in the figures herein, may be arranged and designed in a wide variety of different configurations. Thus, the following detailed description of the embodiments of a system, an apparatus, a method, and a computer program product, as represented in the attached figures, is not intended to limit the scope of the invention as claimed, but is merely representative of selected embodiments of the invention.

If desired, the different functions discussed below may be performed in a different order and/or concurrently with each other. Furthermore, if desired, one or more of the above-described functions may be optional or may be combined. As such, the foregoing description should be considered as merely illustrative of the principles, teachings and embodiments of this invention, and not in limitation thereof.

The present invention combines electronic hardware and software components to create a system, an apparatus, a method, and a computer program product for providing an Internet-based auction for which a bidding process functions in an opposite direction to that of a traditional Internet-based auction (i.e., either online or offline). For example, certain embodiments of the invention provide a buyer, instead of the seller of a product, with the ability to initiate an auction. The buyer initiates the auction for purchasing a specific product. Once the buyer initiates the auction, a seller or sellers dealing in this product can progressively bid the starting price of the product lower and lower until the auction ends. The end of the auction may be designated by a lapse of a time period or a "sell it now" price point being accepted, whichever occurs first. At the conclusion of the auction, the buyer purchases the product at the most favorable price/term(s), and the checkout/payment/shipping portion of the process can commence between the buyer and the "winning" seller.

Figure 1:
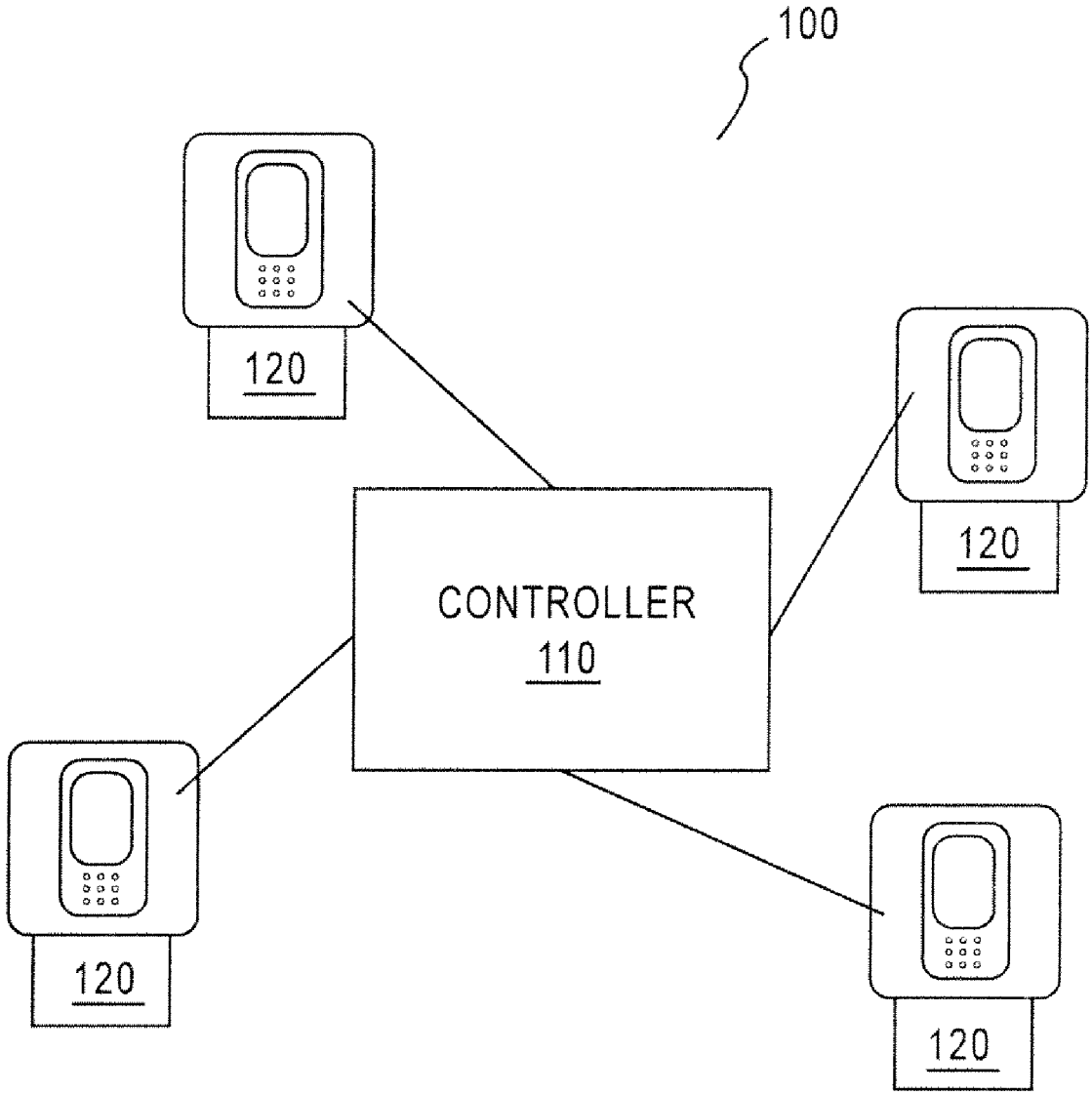
FIG. 1 is a schematic block diagram of a system, in accordance with an embodiment of the invention.

FIG. 1 is a schematic block diagram of a system, in accordance with an embodiment of the invention. As shown in FIG. 1, a system 100 may include a controller 110 and one or more user nodes 120. The controller 110 and the one or more user nodes 120 are configured to communicate with one another over the Internet via a wired or wireless connection.

In accordance with an embodiment of the invention, the controller 110 is configured to receive a request from one of the user nodes 120 to initiate an auction for the purchase of a product. The product may include one of a good or a service. The request may be received via one of, for example, a text message (e.g., SMS or MMS), an e-mail message, a mobile device application, or a website accessed via the mobile device or a personal computer. The request may include information relating to a product that a requesting user (hereinafter referred to as a "buyer") would like to purchase. In certain embodiments, the initial price term of the product is defined by the controller 110 based on market pricing information for the product from online retailers or service providers. In another embodiment of the invention, the initial price term may be defined by the buyer, whereby the buyer-defined initial price term is higher or lower than the price term that would be defined by the controller 110. The initial price term defined by the buyer may include a maximum price the buyer is willing to pay for the product that includes shipping, handling and taxes. Taxes may be defined by the zip code of the buyer.

Upon receiving the request, the controller 110 may be configured to start an auction for the product designated by the buyer. The controller 110 may be configured to receive an initial bid from another user node 120 operated by a user who sells the product of interest (hereinafter referred to as a "seller"). The initial bid includes a price term that is lower than or equal to the initial price term defined by the controller 110. The controller 110 may be further configured to optionally receive one or more subsequent bids from one or more user nodes 120 operated by a seller or sellers of the product. The one or more subsequent bids may be received from the seller transmitting the initial bid. Each subsequent bid includes a price term that is lower than a price term of a preceding bid. The controller 110 may be configured to terminate the auction for the product when a period of time lapses or a "sell it now" price point is accepted, whichever occurs first.

In accordance with another embodiment of the invention, the controller 110 may be configured to terminate the auction for the product when the period of time lapses and no bid has been received by a seller. In this scenario, the buyer can either restart the auction or walk away.

At the conclusion of the auction, the buyer purchases the product from the seller who submitted the last bid before the period of time lapsed or from the seller accepting the "sell it now" price point, whichever occurs first.

In accordance with an embodiment of the invention, the controller 110 is configured to perform a checkout, payment and shipping operation similar to those found in conventional electronic auction systems.

The one or more user nodes 120 may include one of a personal computer, a handheld device, such as a mobile, a cellular telephone, or a personal digital assistant (PDA) having wired or wireless communication capabilities, a portable computer having wired or wireless communication capabilities, and a portable unit or a terminal that incorporates combinations of such functions, as non-limiting examples.

While a single product was discussed above, certain embodiments of the invention are directed to an auction or auctions for multiple products that are linked or bundled together, as will be discussed in more detail below.

Figure 2:
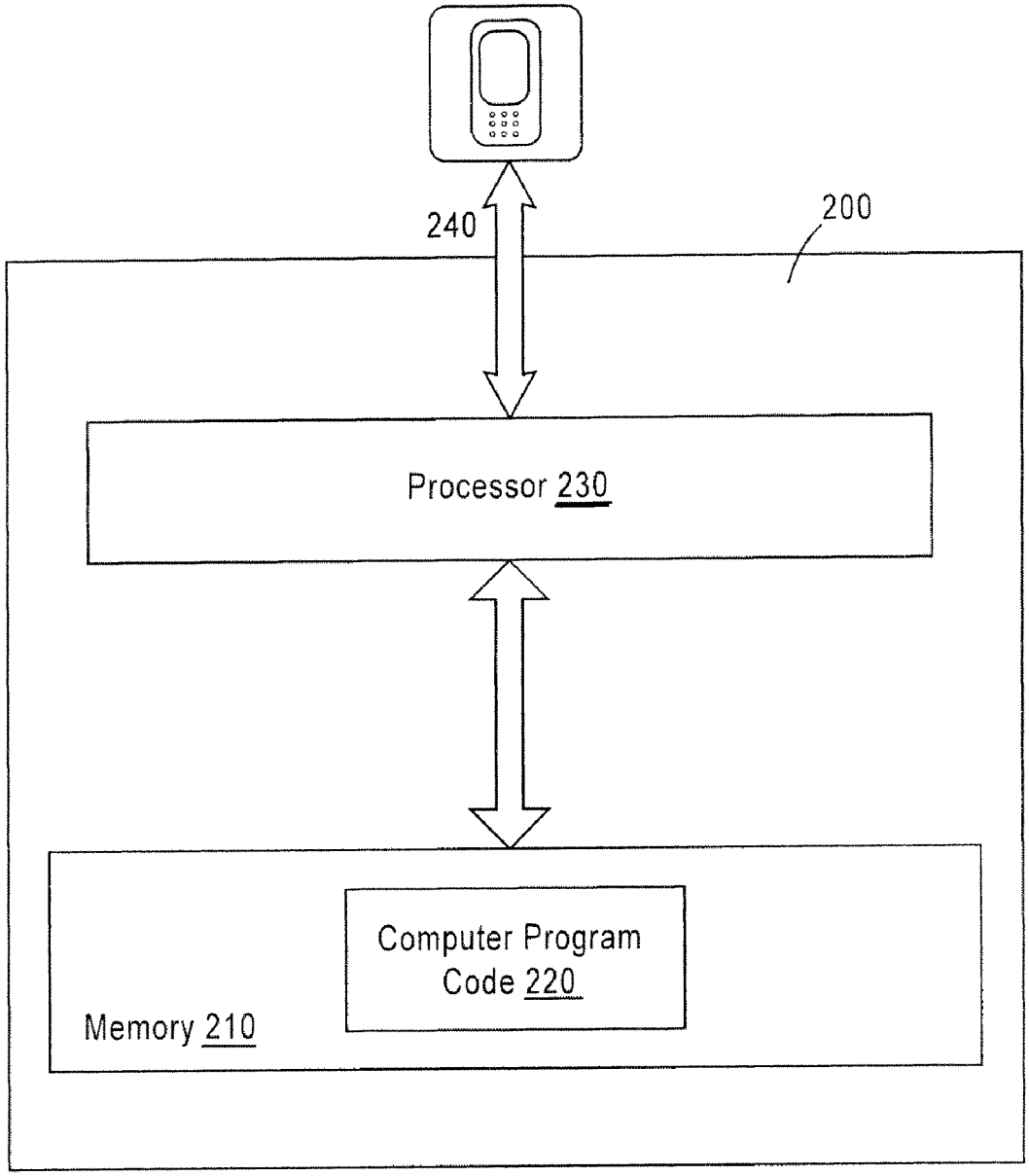
FIG. 2 is a detailed schematic block diagram of an apparatus, in accordance with an embodiment of the invention.

FIG. 2 is a detailed schematic block diagram of an apparatus, such as the controller 110, as shown in FIG. 1, in accordance with an embodiment of the invention. In accordance with certain embodiments of the invention, the apparatus 200 includes a memory 210 including computer program code 220. The computer program code 220 is embodied on a computer readable non-transitory medium. The apparatus 200 includes a processor 230 for processing information and executing instructions or operations. The memory 210 is coupled to the processor 230 for storing information and instructions to be executed by the processor 230. The computer program code 220 is encoded with instructions to control the processor 330 to perform the method discussed below and illustrated in FIG. 11.

While a single memory 210 and a single processor 230 are illustrated in FIG. 2, multiple memory and multiple processors may be utilized according to other embodiments.

Further, the apparatus 200 may be configured to communicate with one or more user nodes, for example, a personal computer, a handheld device, such as a mobile, a cellular telephone, or a personal digital assistant (PDA) having wired or wireless communication capabilities, a portable computer having wired or wireless communication capabilities, and a portable unit or a terminal that incorporates combinations of such functions, as non-limiting examples. The apparatus 200 may communicate with the one or more user nodes over a wired or wireless link 240.

In accordance with another embodiment of the invention, the processor 230 is configured to receive a request from one of the user nodes to initiate an auction for the purchase of a product. The request may be received via one of, for example, a text message (e.g., SMS or MMS), an e-mail message, a mobile device application, or a website accessed via a mobile device or a personal computer. For example, the processor 230 may be configured to receive a request in the form of a text message from a non-smart phone. The text message may include one of a UPC number or a model number of a product of interest, or a search cue to search for the product of interest. Accordingly, certain embodiments of the invention provide a buyer with the ability, for example to initiate an auction, get auction updates, save items to a shopping cart or wishlist, manage a buddy list, and receive status reminders solely using text messages via a non-smart phone.

The request may further include information relating to a product that a buyer would like to purchase. In an embodiment of the invention, the processor 230 is configured to define the initial price term of the product selected by the buyer based on market pricing information for the product from online retailers or service providers. As previously discussed, the initial price term may be defined by the buyer, whereby the buyer-defined initial price term is higher or lower than the price term that would be defined by the processor 230. The initial price term defined by the buyer may include a maximum price the buyer is willing to pay for the product that includes shipping, handling and taxes. Taxes may be defined by the zip code of the buyer.

In response to the request, the processor 230 may be configured to initiate an auction for the product selected by the buyer. The processor 230 may further be configured to receive an initial bid from another user node operated by a seller of the product. The initial bid includes a price term that is lower than or equal to the initial price term defined by the buyer or the processor 230. The processor 230 may also be configured to receive one or more subsequent bids from one or more user nodes 120 operated by a seller or sellers of the product. The one or more subsequent bids may be received from the seller transmitting the initial bid. Each subsequent bid includes a price term that is lower than a price term of a preceding bid.

The processor 230 may be configured to terminate the auction for the product when a period of time lapses or a "sell it now" price point is accepted. In accordance with an embodiment of the invention, the period of time, for example 30 minutes, 2 hours, 2 days, etc., for the auction may be defined by the processor 230 or the buyer prior to the initiation of the auction. The "sell it now" price point may be a pre-defined pricing term that is defined by the processor 230 that is lower than the initial auction price (i.e., at a percentage discount of the initial auction price), or by the buyer (i.e., a price that a buyer is willing to pay to a seller in return for an immediate purchase of the product or a shortened auction—similar to the "buy it now" feature on conventional online auction systems). The buyer purchases the product from the seller who submitted the last bid before the period of time lapsed or from the seller accepting the "sell it now" price point, whichever occurs first.

In accordance with another embodiment of the invention, the processor 230 may be configured to terminate the auction for the product when the period of time lapses and no bid has been received by a seller. In this scenario, the buyer can either restart the auction or walk away.

At the conclusion of the auction, the processor 230 is configured to perform a checkout, payment and shipping operation similar to those found in conventional electronic auction systems.

Figure 3A:
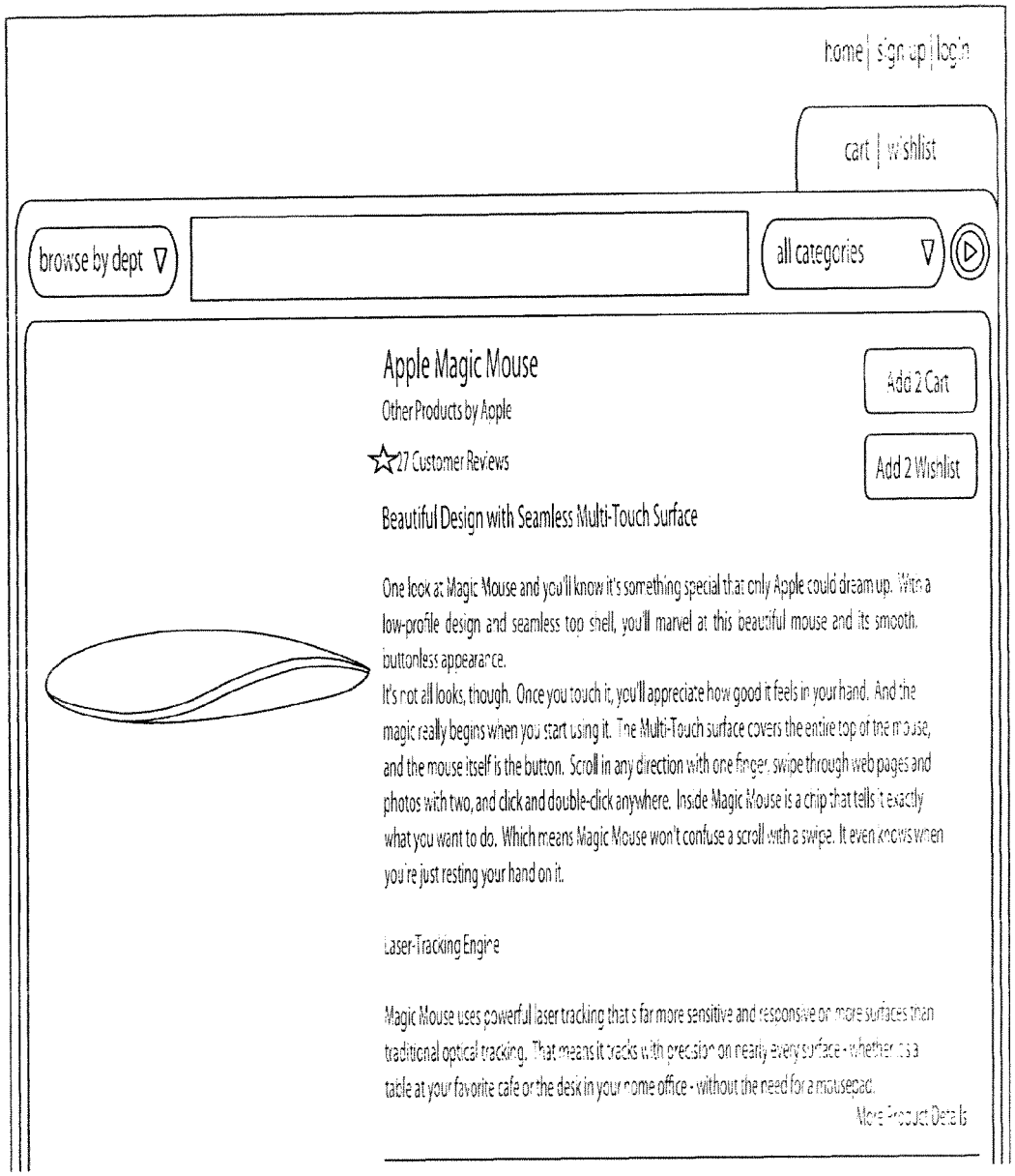
FIG. 3 is a product detail view of a graphical user interface of a user node, in accordance with an embodiment of the invention.
Figure 3B:
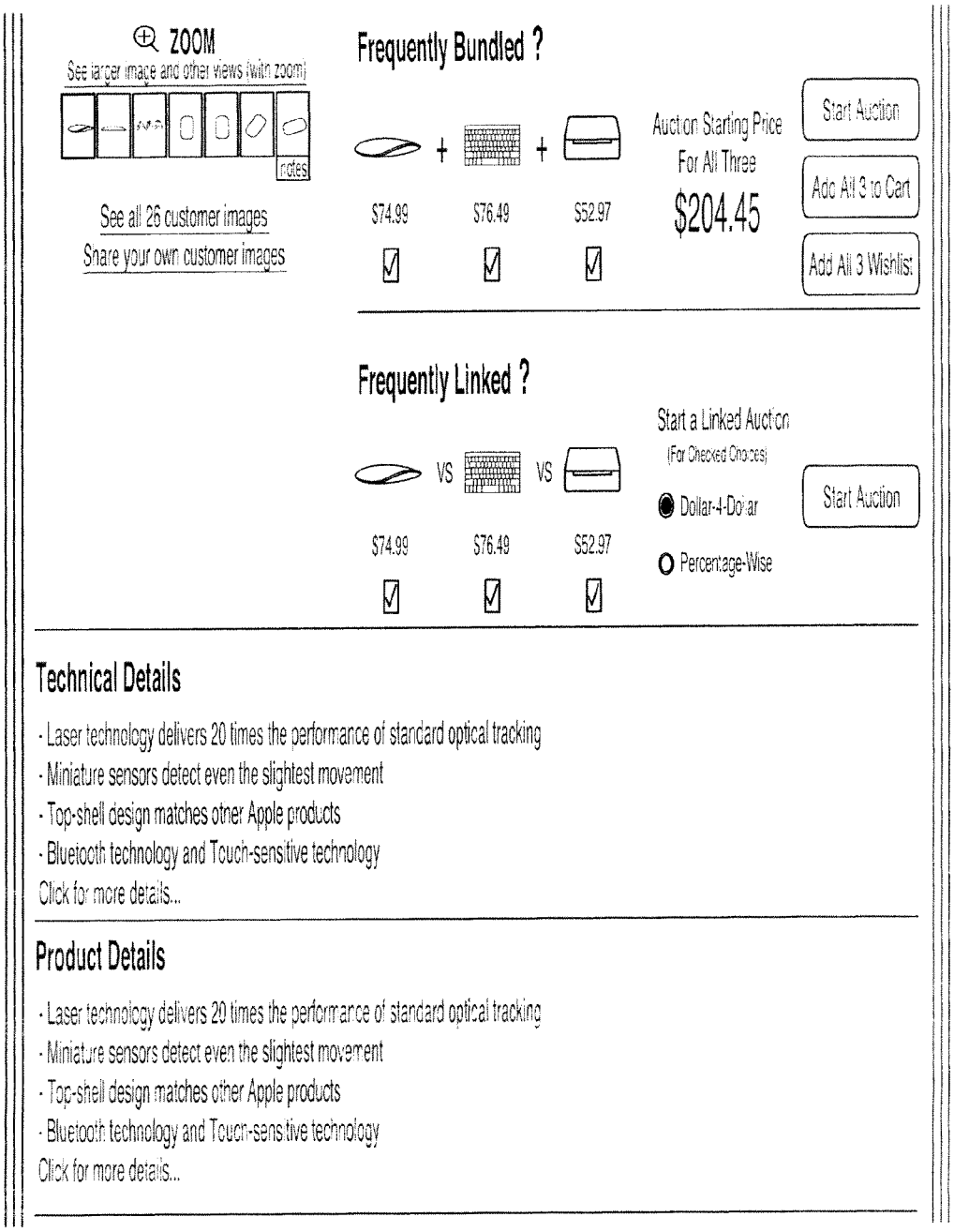

FIG. 3 is a product detail view of a graphical user interface of a user node, in accordance with an embodiment of the invention. In accordance with another embodiment of the invention, the processor 230 is configured to transmit information describing to a product, when a request for product information is received from a buyer. For example, as shown in FIG. 3, the transmitted information may include a summary description of the product, one or more pictures, general and technical details of the product, a detailed product description, and customer reviews for the product.

As shown in FIG. 3, the product detail view permits the buyer to add the product to the buyer's shopping cart or wishlist, which will be described in more detail below.

As shown in FIG. 3, the product detail view may also include frequently bundled or frequently linked auction options. The frequently bundled and the frequently linked auction options may include products that have been bundled or linked by the processor 230 based on purchasing trends or recommendations of other buyers who have purchased this product. For example, in accordance with another embodiment of the invention, the processor 230 is configured to bundle a plurality of products, for which a single auction is initiated for the bundle of products for an initial price term. A seller interested in bidding on the bundle must be able to supply all of the products in the bundle to the buyer.

In accordance with another embodiment of the invention, the processor 230 may be configured to link a plurality of products, for which the buyer expressly intends to purchase less than all of the products. For example, the processor 230 may receive a request from the buyer to purchase three products (e.g., Product A, Product B and Product C). The processor 230 may be configured to define the initial relative price term of each of the three products (i.e., so that the initial price term of the most expensive product cannot be more than two times the initial price term of the least expensive product). The processor 230 is configured to display each product auction independently of the others, so that a seller cannot easily identify that these three products are linked to one another. As a result, a seller would only be bidding on a specific product independent of the other two products. In this linked auction, the buyer purchases one or more of the three products based on a buyer-defined algorithm. The buyer-defined algorithm may include, for example, one of a dollar-4-dollar algorithm, a percentage algorithm, or an overall lowest price algorithm.

For the following algorithm examples, it is assumed that the initial price term of the products are as follows:

| | |
|---|---|
| Product A: | $300 |
| Product B: | $200 |
| Product C: | $100 |

In the dollar-4-dollar algorithm, the processor 230 is configured to receive a bid from a seller for one of the three products. The processor 230 is configured to adjust the price of the other linked products based on the difference between the seller's bid and the current price of the product. For example, if a seller bids $280 for Product A, the price of Products B and C are reduced to $180 and $80, respectively (i.e., the bid for Product A is $20 less than the initial price term for Product A, and therefore Products B and C are also reduced by $20). If a second seller subsequently bids $50 for Product C, then Products A and B would be reduced by $30 to $250 and $150, respectively. This linked auction would continue until the period of time for the auction lapses or a "sell it now" price point is accepted, whichever occurs first. At the conclusion of the auction, the buyer is committed to purchase the overall winning product but may also purchase one or all of these three products from the seller or sellers.

In the percentage algorithm, the processor 230 is configured to receive a bid from a seller for one of the three products. The processor 230 is configured to adjust the price of the other linked products based on a percentage difference between the seller's bid and the current price of the product. For example, if a seller bids $270 for Product A, the price of Products B and C are reduced to $180 and $90, respectively (i.e., the bid for Product A is a 10% reduction of the initial price term of Product A, and therefore Products B and C are also reduced by 10%). If a second seller subsequently bids $100 for Product B, then Products A and C would be reduced by 50% of their initial price to $150 and $50, respectively. This linked auction would continue until the period of time for the auction lapses or a "sell it now" price point is accepted, whichever occurs first. At the conclusion of the auction, the buyer is committed to purchase the overall winning product but may also purchase one or all of these three products from the seller or sellers.

In an overall lowest price algorithm, the processor 230 is configured to adjust the initial price term of all of the products to be the lowest initial price term of the three products at the initiation of the auction. For example, if the buyer requests that an overall lowest price algorithm be used, the processor 230 is configured to adjust the initial price for Products A, B and C to $100. The processor 230 is configured to receive a bid from a seller for one of the three products. The processor 230 is configured to adjust the price of the other linked products based on the bid so that the current price for all products is identical. For example, if a seller bids $50 for Product C, the price of Products A and B are also reduced to $50. If a second seller subsequently bids $25 for Product B, then Products A and C would be reduced to $25. This linked auction would continue until the period of time for the auction lapses or a "sell it now" price point is accepted, whichever occurs first. At the conclusion of the auction, the buyer is committed to purchase the overall winning product but may also purchase one or all of these three products from the seller or sellers.

Figure 4:
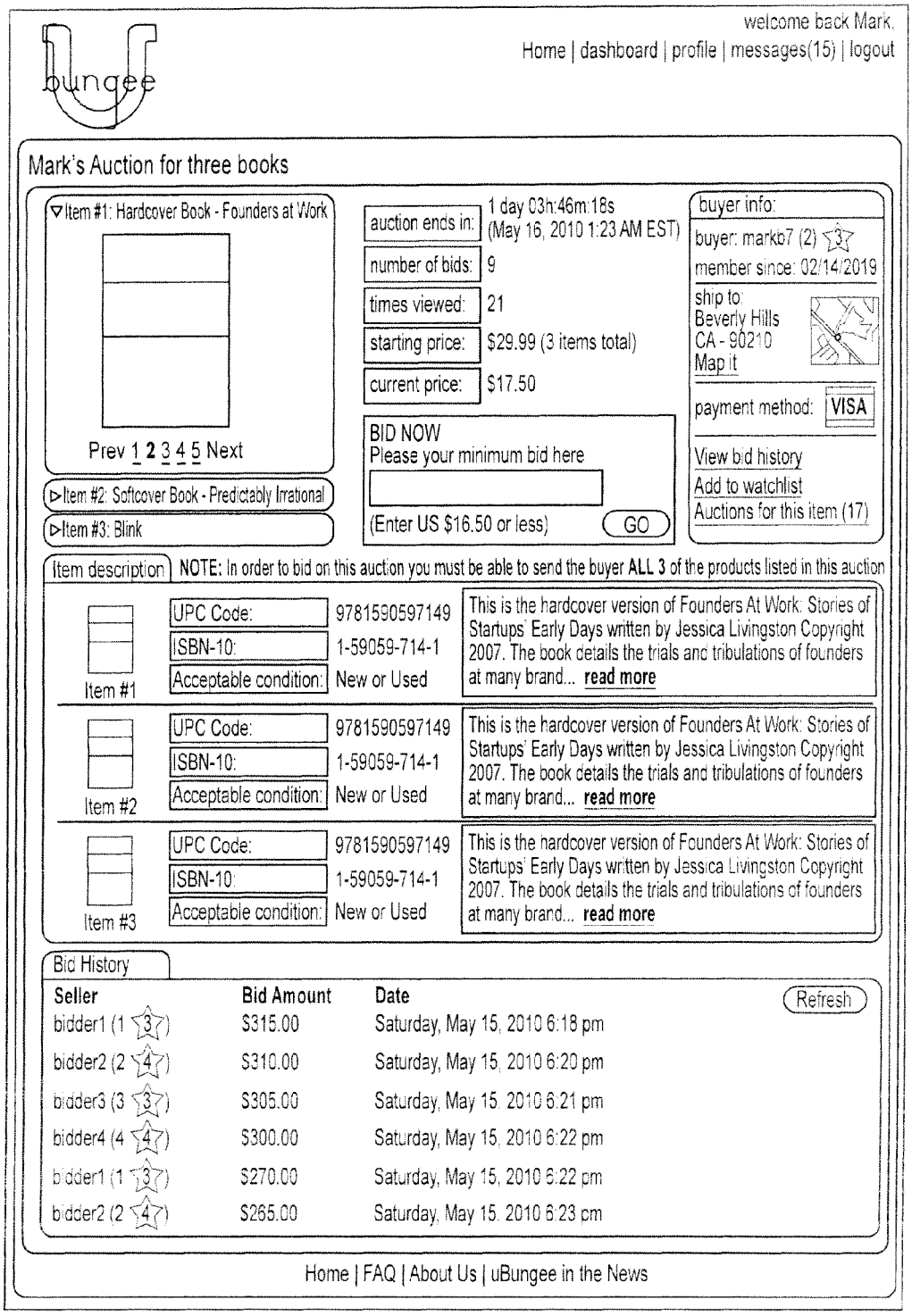
FIG. 4 is a live auction view of a graphical user interface of a user node, in accordance with an embodiment of the invention.

FIG. 4 is a live auction view of a graphical user interface of a user node, in accordance with an embodiment of the invention. In accordance with an embodiment of the invention, the processor 230 is configured to transmit information relating to a product auction to a user node, so that the user can monitor, through the user node, a live product auction, including the time period set for the auction, the number of bids made by sellers for this product, the feedback ratings of the sellers bidding on the auction, the number of times that the auction has been viewed, the initial price term (or "starting price") of the product (which includes shipping, handling and taxes), the current price of the product, and the ability for the user (i.e., the seller) to place a bid for the product. The live auction view may provide the user with, for example, the buyer's information, including, for example email information, shipping information, user feedback rating, information and the buyer's available payment method. The live auction view may also provide the user with, for example, one or more pictures and a description of the product, the UPC number and the ISBN of the product, and the buyer's accepted condition of the product (e.g., new, used, etc.). Further, the live auction view may show a bid history for the product, including, for example, a listing of the sellers who have placed bids on the product, their respective feedback ratings, the amount of the sellers' bids, and the date and time of each bid.

FIG. 5 is an auction activity view of a graphical user interface of a user node, in accordance with an embodiment of the invention. In accordance with an embodiment of the invention, the processor 230 is configured to transmit information relating to a user's auction activity. As shown in FIG. 5, a user may be provided with a list of, for example, the user's (1) current auctions, (2) rebuy requests, (3) past and present jumpballs, (4) future jumpballs, and (5) sales history, based on whether the user is a buyer, seller or both.

The list of current auctions may include, for example, the title of a product that the user is watching, has initiated, or has placed a bid on, the time remaining in the auction, the number of bids already posted for the product, the current or leading bid, the user's lowest bid for the product (i.e., if the user is a seller), and an option for the user to submit a new bid or view the auction (i.e., if the user is a seller).

The auction activity view may further provide a user with a list of pending rebuy requests. A rebuy request is a request by a buyer, who was happy about the delivery of the product(s) and who would like to request that the same deal for the product(s) be offered again to the buyer by the "winning" seller. The rebuy request allows the seller the opportunity to capitalize on the buyer's loyalty and repeat the sale of the product under the past sale's conditions. If the seller rejects the opportunity, then the buyer may be informed and offered the chance to restart a new auction for the desired product(s). The list of rebuy requests may include, for example, the title of the product, the winning bid of the product, the name of the buyer who is requesting the rebuy request or the seller who originally sold the product, a time period remaining for the rebuy request (i.e., which may be defined by the seller or the processor 230), and an option for the user (i.e., if the user is a seller) to view, accept or reject the rebuy request.

As further shown in FIG. 5, a list of jumpball auctions may be provided to the user by the processor 230. The list of jumpball auctions may include past and present jumpball auctions and future jumpball auctions that are made available to a user's buddy list. Past and present jumpball auctions are those that a seller has already initiated, while future jumpball auctions are those that are available for the seller to offer. The jumpball option provides the "winning" seller with the ability to provide the buyer with the opportunity to offer the "winning" price to the buyer's friends or buddies (i.e., the buyer's gift buddies and/or saver buddies). A user's buddy or buddies will be described in more detail below. When the "winning" seller offers a jumpball on a product, the product information and the "winning" bid are "in play," during which the buyer's buddies can purchase an identical product at the "winning" bid price term, for a pre-defined period of time (i.e., defined by the seller or the processor 230) or until the first buddy accepts the deal. Once the jumpball is taken (i.e., the jumpball is won), the processor 230 is configured to terminate the jumpball offer (i.e., first-come, first-served). In another embodiment of the invention, more than one product can be offered (i.e., bundled) to the buyer's buddies. In another embodiment of the invention, the jumpball may be offered to users outside of the buyer's buddies to incentivize other users to perform certain actions, such as, for example, signing up as a new user to the system, or encouraging non-buddies to become buddies with the offering buyer/winner seller.

As further shown in FIG. 5, the processor 230 is configured to provide a sales history or purchase history of products. For example, for a seller, the processor 230 may be configured to show a title of a product sold, the "winning" bid, the buyer's name, the starting time and ending time of the auction, and options for the seller to leave feedback about the buyer or the auction process (i.e., quality assurance feedback), to offer a jumpball for the product, or to delete the product from the sales history (i.e., thus terminating the opportunity to offer a jumpball for this product).

Figure 6A:
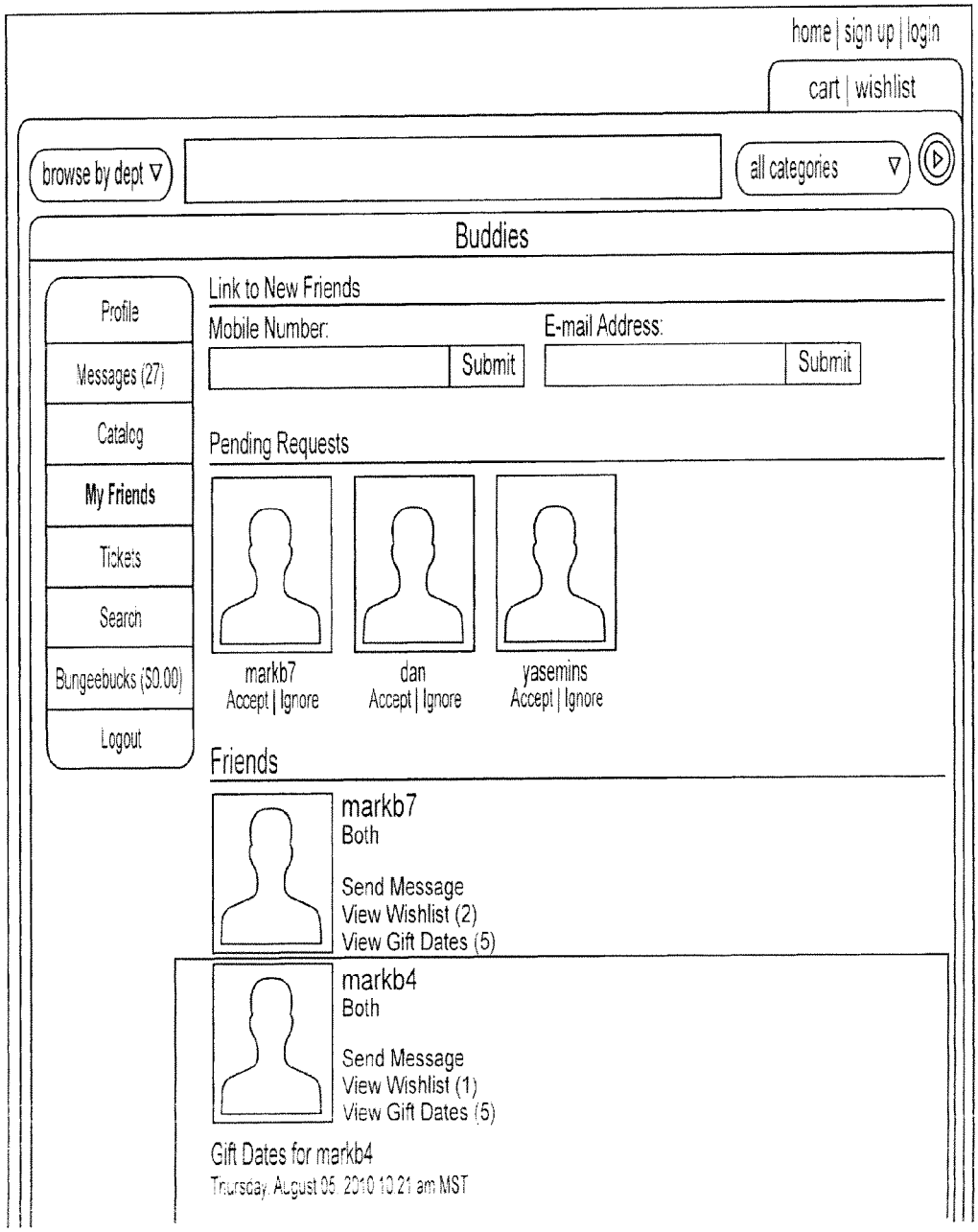
FIG. 6 is a buddy view of a graphical user interface of a user node, in accordance with an embodiment of the invention.
Figure 6C:
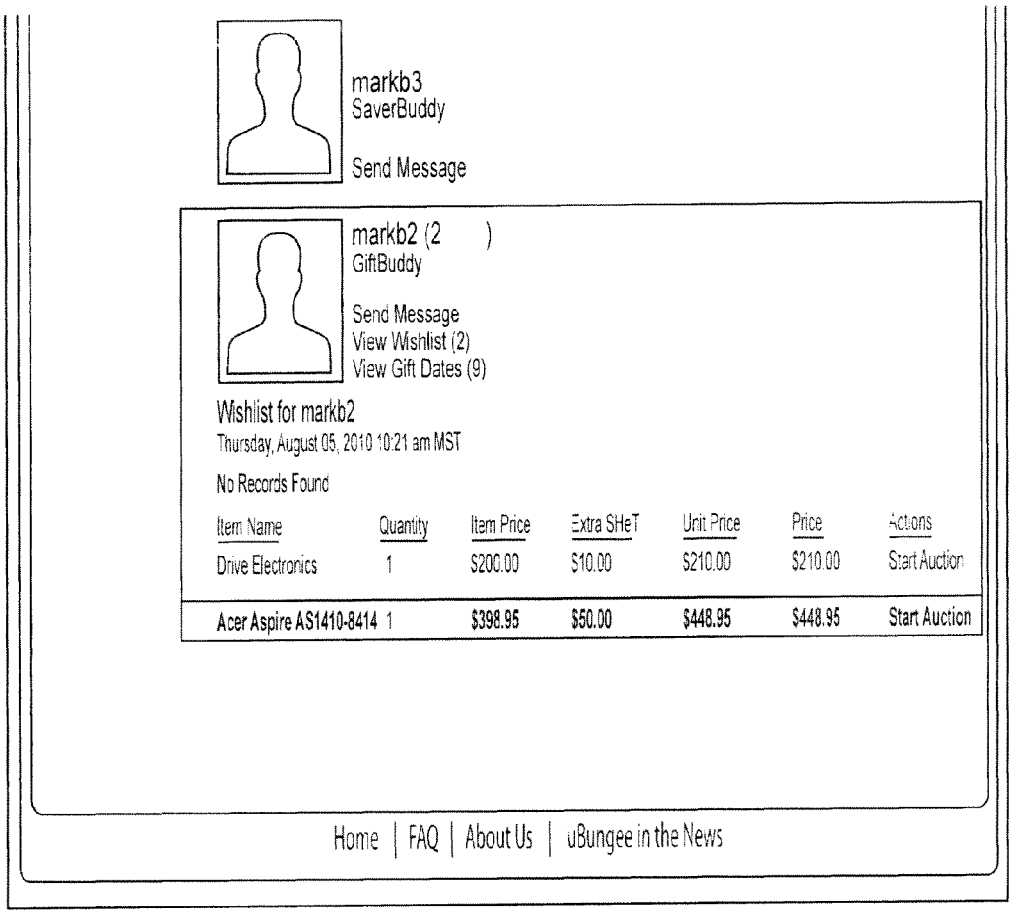

FIG. 6 is a buddy view of a graphical user interface of a user node, in accordance with an embodiment of the invention. In accordance with an embodiment of the invention, the processor 230 is configured to transmit information relating a user's buddy list. A user's buddy list may include, for example, a list of the user's buddies that the user has designated as a gift buddy, a saver buddy, or both. The user's buddy list may also list pending buddy requests from other users, for which the user can accept or ignore each request. A gift buddy may include a friend that a user purchases gifts for throughout the year (or vice versa). Thus, the gift buddy is more than a casual friend. By designating a friend as a gift buddy, the user is provided with access to the gift buddy's wishlist and an event reminder list to assist the user with remembering important dates. As shown in FIG. 6, the processor 230 may be configured to provide the user with the event reminder list that has customizable features (i.e., event name, date of the event, countdown timer to the event, frequency of the event, action items, etc.). The processor 230 may be configured to send a user a text message or an e-mail message reminding the user of upcoming dates/events related to a gift buddy. The processor 230 may further be configured to provide the user with a wishlist (i.e., so that a user can purchase a product that the gift buddy actually has requested) that identifies the title of the product, quantity of the product desired, item price, shipping, handling and tax information for the product, and an action button to start an auction for the product. The saver buddy is a designated friend who the user does not regularly exchange gifts with, but for whom the user regularly communicates with via text message or e-mail message about good deals, to whom coupons are exchanged, or to whom jumpballs are offered. In certain embodiments of the invention, jumpballs are also provided to gift buddies, and also to users outside of the user's buddy list, as previously discussed.

Figure 7:
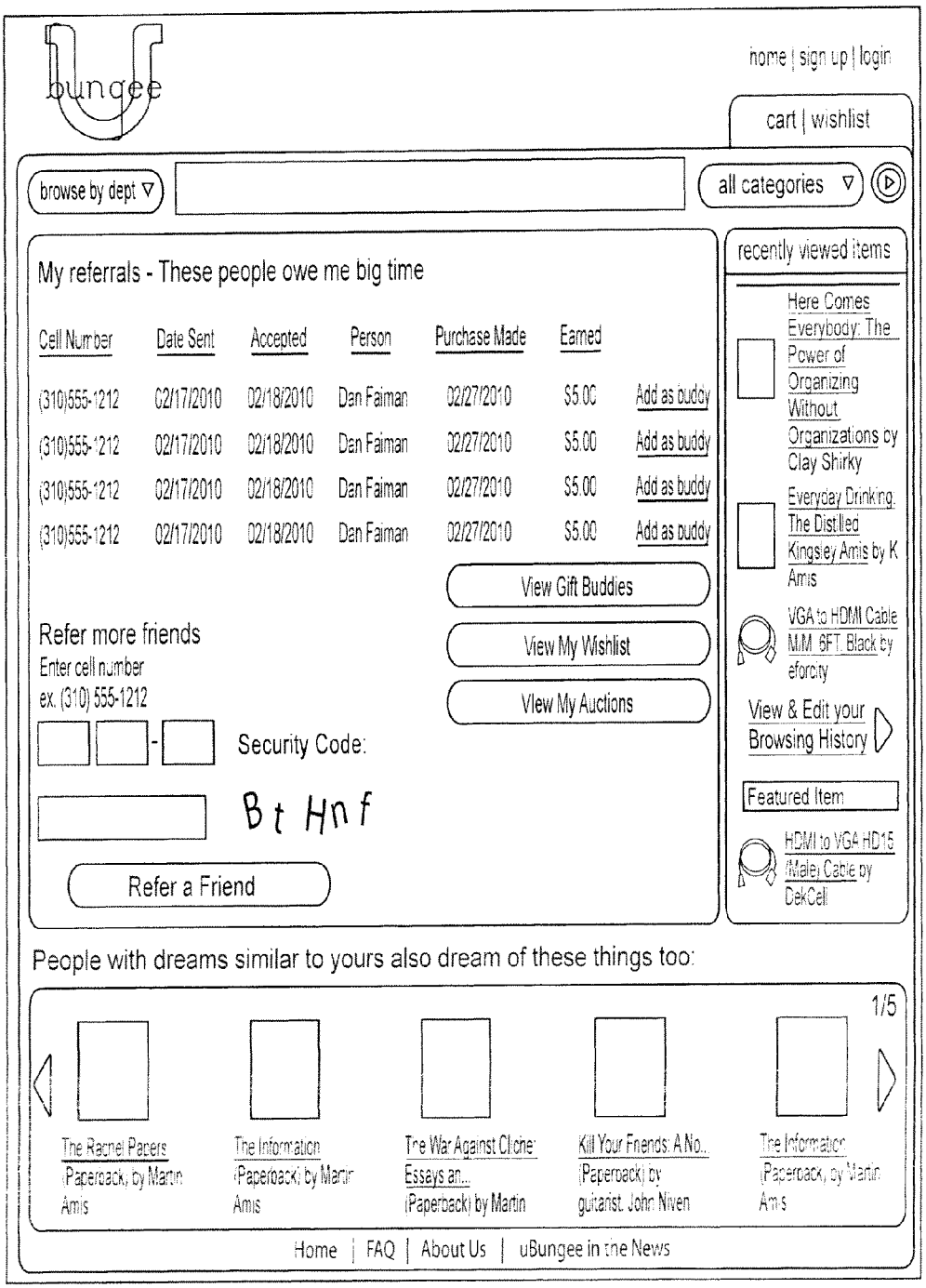
FIG. 7 is a referral view of a graphical user interface of a user node, in accordance with an embodiment of the invention.

FIG. 7 is a referral view of a graphical user interface of a user node, in accordance with an embodiment of the invention. In accordance with an embodiment of the invention, the processor 230 is configured to transmit information relating to a user's referrals. For example, the referral view may show a list of individuals that the user has referred. In accordance with an embodiment of the invention, the processor 230 may be configured to receive a referral from a user, through the user node, using a unique identifier, an email address, or a phone number, to identify the referred individual, permitting a non-smart phone user to send the unique identifier to the processor 230 using a text message. By submitting a referral, the processor 230 may be configured to provide the user with a credit that can be used to purchase products, once the referred individual accepts an invitation from the processor 230 to join the system.

Figure 8:
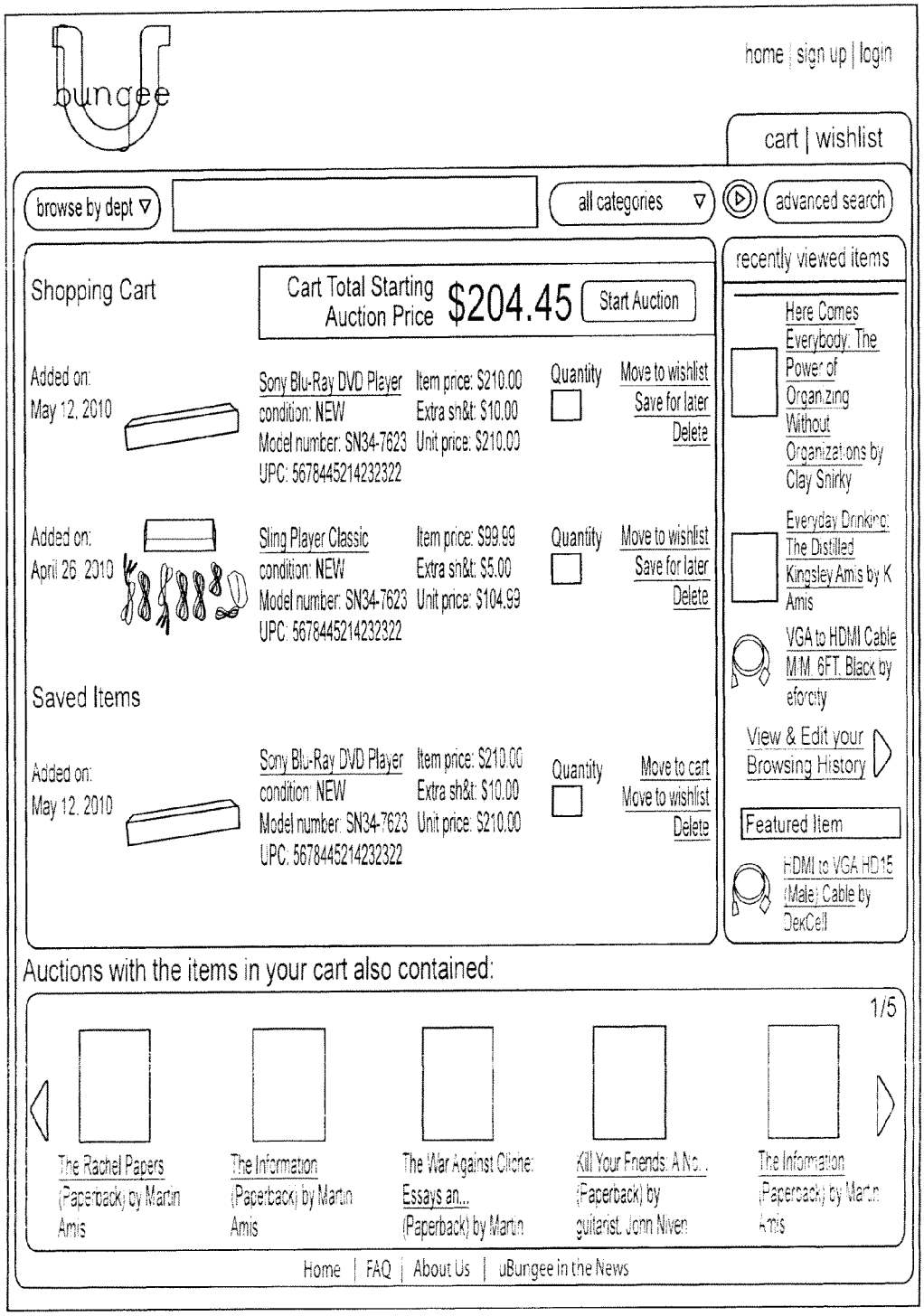
FIG. 8 is a shopping cart view of a graphical user interface of a user node, in accordance with an embodiment of the invention.

FIG. 8 is a shopping cart view of a graphical user interface of a user node, in accordance with an embodiment of the invention. As shown in FIG. 8, the processor 230 may be configured to transmit information relating to products that have been saved in a user's shopping cart. In the shopping cart view, the processor 230 also may provide the user with the ability to initiate an auction on a product or products. The shopping cart view may also include a list of products that were recently viewed by the user and a list of recommended products based on the user's previous purchasing or bidding history.

Figure 9:
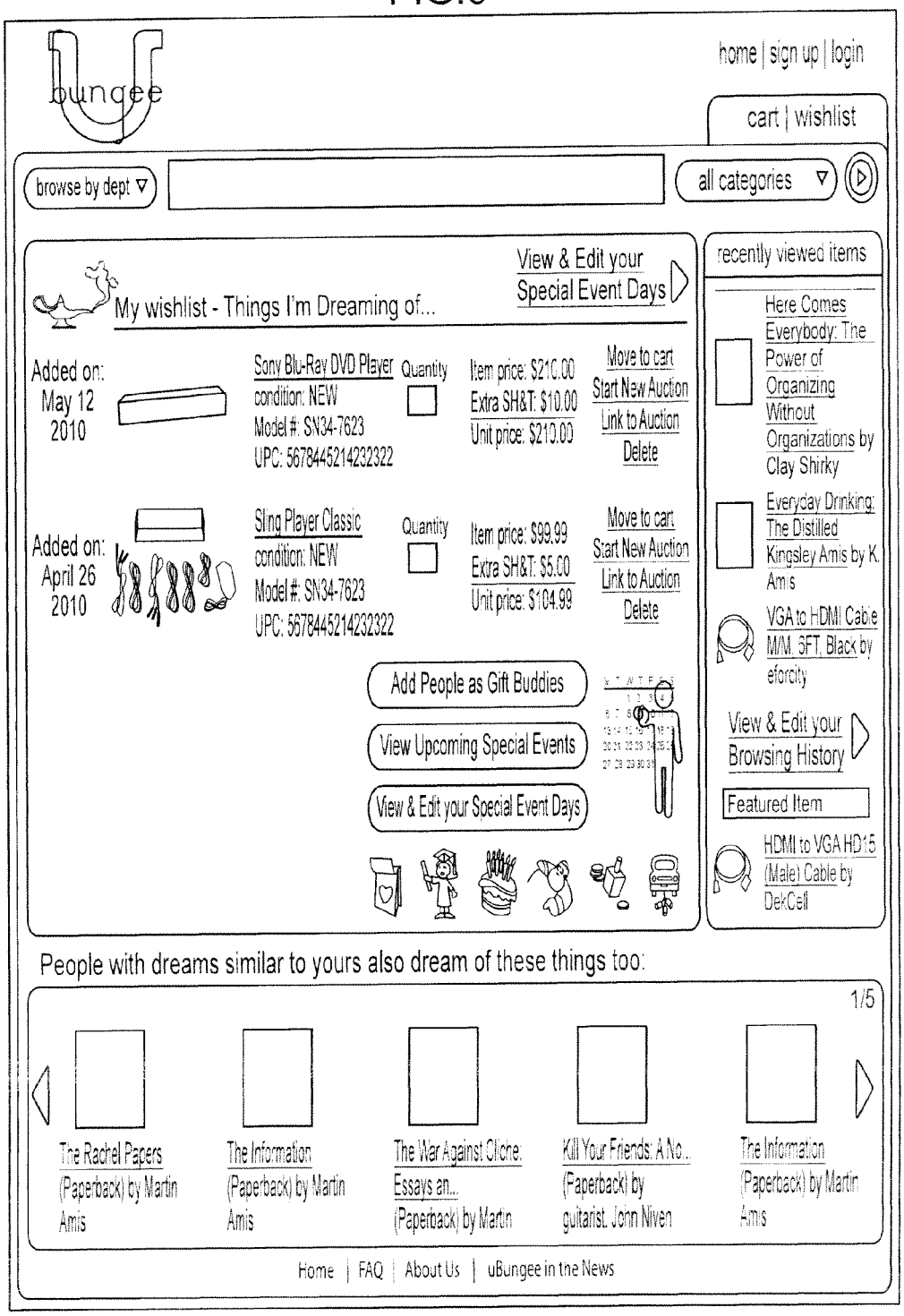
FIG. 9 is a wishlist view of a graphical user interface of a user node, in accordance with an embodiment of the invention.

FIG. 9 is a wishlist view of a graphical user interface of a user node, in accordance with an embodiment of the invention. As shown in FIG. 9, the processor 230 may be configured to transmit information relating to a list of products that a user wishes to purchase. The processor 230 may be configured to move one or more of these products to the shopping cart, so that an auction can be initiated for a product or products. In the wishlist view, a user may be able to add people as a gift buddy and view upcoming events. The wishlist view may also include a list of products that were recently viewed by the user and a list of recommended products based on the user's previous purchasing or bidding history.

As previously discussed, the processor 230 may also be configured to transmit a text message or an e-mail message to a user node to notify a user of an upcoming event or important date. Upon receiving the notification, the user may review the buddy's wishlist and start an auction for a product listed on the buddy's wishlist (i.e. purchase that product). Once the auction is initiated, no other user can purchase the product directly from the buddy's wishlist, thereby preventing duplicate purchases, while keeping the purchase secret from the buddy. For example, once an auction is started from a gift buddy's wishlist, the product on the wishlist is locked up behind the scenes. From anyone's perspective viewing the wishlist, nothing appears different (i.e., the lockup mechanism is not seen). Only once a subsequent gift buddy, or the recipient themselves, attempts to purchase the product by starting an auction for the locked up product would a message be revealed that the product is actually locked up.

Figure 10A:
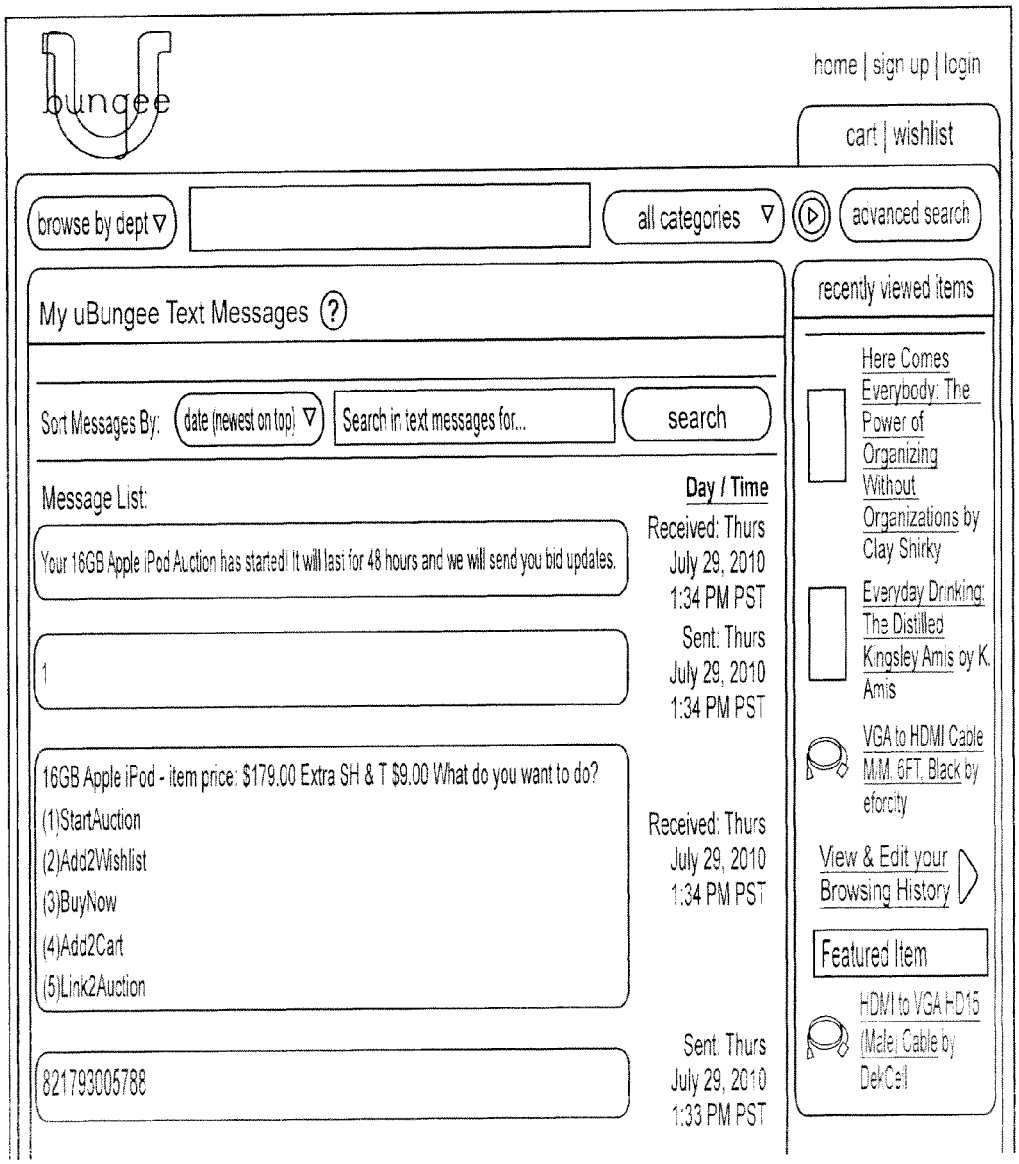
FIG. 10 is a text message summary view of a graphical user interface of a user node, in accordance with an embodiment of the invention.

FIG. 10 is a text message summary view of a graphical user interface of a user node, in accordance with an embodiment of the invention. As shown in FIG. 10, the processor 230 may be configured to transmit information relating to a text message history of a user node. The text message summary view may also include a list of products that were recently viewed by the user and a list of recommended products based on the user's previous purchasing or bidding history.

In accordance with another embodiment of the invention, the processor 230 may be configured to provide an auction predictor/estimator mechanism. For example, the processor 230 may be configured to perform a function (i.e., algorithm) using at least one of the buyer's zip code, the payment method used by the buyer, the chosen duration of the auction, the product(s) being auctioned, a history of the "winning" bids and preceding bid prices, and whether a product was linked to other products or not, to predict or estimate what the final "winning" bid (or "winning" range) is likely to be. This information may be presented in a time plot graph (i.e., a 24-hour auction, where the initial price term is $200, $193 after 2 hours have elapsed, $187 after 4 hours have elapsed, $173 after 5 hours have elapsed, $168 with 1 minute remaining, and $153 being the "winning" bid).

Figure 11:
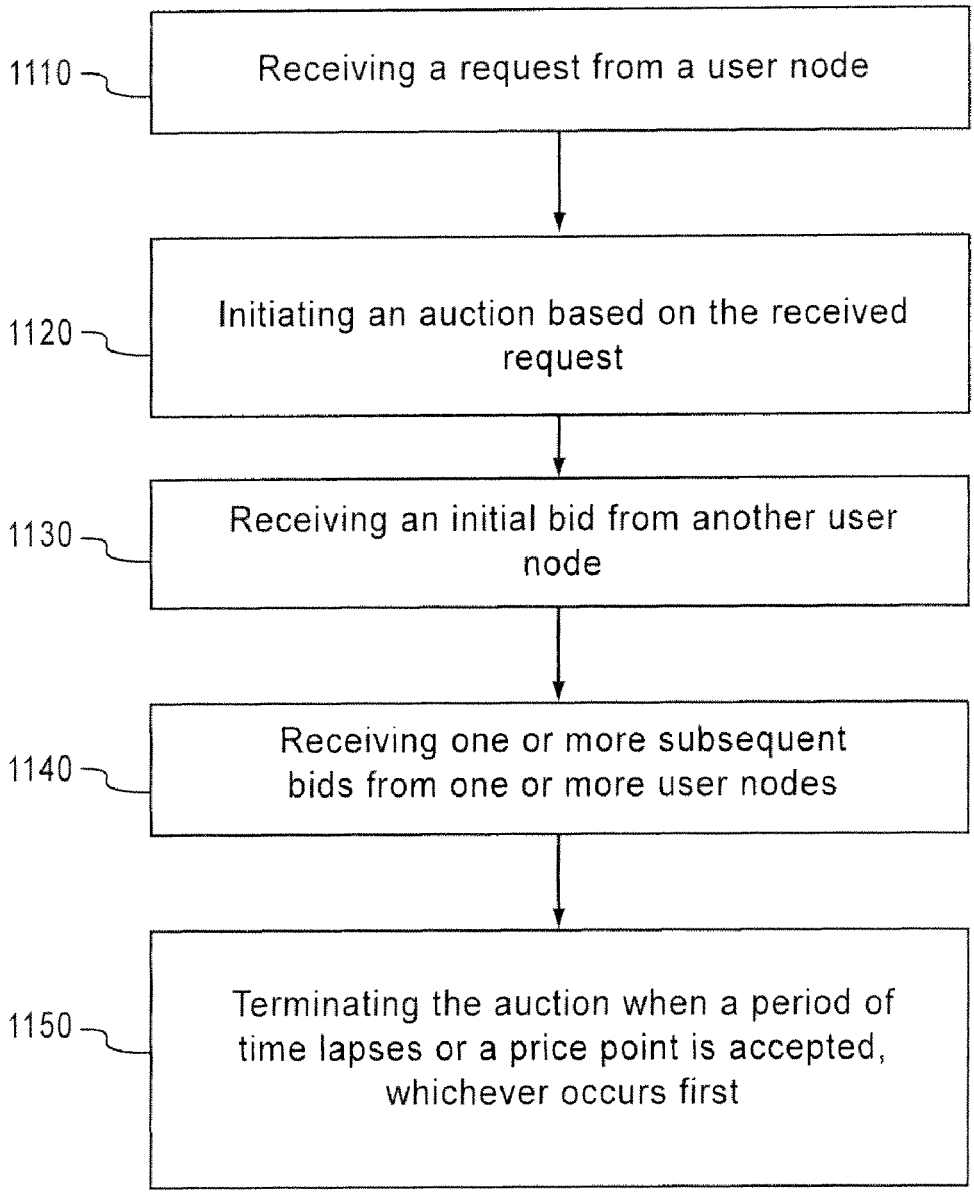
FIG. 11 is a flow diagram of a method for providing an auction, in accordance with an embodiment of the invention.

FIG. 11 is a flow diagram of a method for providing an auction, in accordance with an embodiment of the invention. In step 1110, the method includes receiving a request from a user node to initiate an auction for the purchase of a product. The request may be received via one of, for example, a text message (e.g., SMS or MMS), an e-mail message, a mobile device application, or a website accessed via a mobile device or a personal computer. The step of receiving the request may include receiving a text message from the user node. The text message may include one of a UPC number or a model number of a product of interest, or a search cue to search for the product of interest. Accordingly, certain embodiments of the invention provide a buyer with the ability, for example to initiate an auction, get auction updates, save items to a shopping cart or wishlist, manage a buddy list, and receive status reminders solely using text messages via a non-smart phone.

The request may further include information relating to a product that a buyer is interested in purchasing and an initial price term defined by the buyer. In accordance with an embodiment of the invention, the step of receiving the request includes defining an initial price term of the product selected by the buyer based on market pricing information for the product from online retailers or service providers. As previously discussed, the initial price term may be defined by the buyer, whereby the buyer-defined initial price term is higher or lower than the price term that would be defined by the processor 230. The initial price term defined by the buyer may include a maximum price the buyer is willing to pay for the product that includes shipping, handling and taxes. Taxes may be defined by the zip code of the buyer.

In step 1120, the method may include initiating an auction for the product selected by the buyer, in response to receiving the request. The method further includes receiving an initial bid from another user node operated by a seller of the product (step 1130). The initial bid includes a price term that is lower than or equal to the initial price term defined by the buyer or the processor 230. Further, the method may include receiving one or more subsequent bids from one or more user nodes 120 operated by a seller or sellers of the product (step 1140). The one or more subsequent bids may be received from the seller transmitting the initial bid. Each subsequent bid includes a price term that is lower than a price term of a preceding bid.

Further, the method may include terminating the auction for the product when a period of time lapses or a "sell it now" price point is accepted (step 1150). In accordance with an embodiment of the invention, the period of time, for example 30 minutes, 2 hours, 2 days, etc., for the auction may be defined by a processor or the buyer prior to the initiation of the auction. The "sell it now" price point may be a pre-defined pricing term that is defined by the processor that is lower than the initial auction price (i.e., at a percentage discount of the initial auction price), or by the buyer (i.e., a price that a buyer is willing to pay to a seller in return for an immediate purchase of the product—similar to the "buy it now" feature on conventional online auction systems). The buyer purchases the product from the seller who submitted the last bid before the period of time lapsed or from the seller accepting the "sell it now" price point, whichever occurs first.

In accordance with another embodiment of the invention, the method includes terminating the auction for the product when the period of time lapses and no bid has been received by a seller. In this scenario, the buyer can either restart the auction or walk away.

At the conclusion of the auction, the method may include performing a checkout, payment and shipping operation similar to those found in conventional electronic auction systems.

Embodiments of the invention provide advantages to both the buyer and the seller. For example, certain embodiments of the invention enable a buyer to initiate an auction on a specified product without being tethered in real-time to the auction (i.e., the buyer does not have to constantly monitor the auction to ensure that the buyer is the lowest bidder on the specified product). The buyer can initiate, track and purchase products via the auction directly from a mobile device, even if the mobile device is not a "smart" device, using a text message, a phone application, or access through a website. The buyer can create linked auctions, registries, and wishlists, so that friends and family have an idea of the products that are of interest to the buyer. The seller can save money with fewer fees, faster auctions, and less sales/marketing dollars spent. The seller can also save time by eliminating the need for setting up the auctions, by getting follower notifications when the seller's products are desired, and by avoiding "window-shopper" buyers. Sellers only deal with committed buyers and only sell for a price the seller knows meets its financial goals.

Certain embodiments of the invention allow this type of auction to be provided on a "pocketable" device, which is not possible under the traditional auction structure, by linking several auction items together with the express intent by the buyer to purchase less than all of the items. The system discussed above establishes a unique ability for both buyers and sellers to advertise their purchase desires and products, i.e., advertising and marketing, respectively, to the other parties via a variety of communication methods, e.g., SMS, MMS, phone apps, e-mail messages, etc. Thus, the portable auction system delivers unique positioning in the growing mobile advertising space.

Another innovative feature of the portable auction system is the ability for payments to be initially authorized and then later consummated via a mobile device using the same SMS/MMS/App methods previously discussed. This functionality provides an increased level of security over the more traditional instant payment mechanisms used today since the payment process is spread out over several days and communication touch points.

Further to the discussion above, it is to be understood that in an embodiment of the invention, the steps and the like may be changed without departing from the spirit and scope of the present invention. In addition, the method described in FIG. 11 may be repeated numerous times.

The steps of the method, as illustrated for example in FIG. 11, described in connection with the embodiments disclosed herein may be embodied directly in hardware, in a computer program product (e.g., computer program code 220) executed by a controller (e.g., controller 110) or a processor (e.g., processor 230), or in a combination of the two. The computer program product may be embodied on a computer readable medium, such as a storage medium. The computer readable (i.e., non-transitory) storage medium may include any media or means that may contain, store, communicate, propagate or transport the instructions for use by or in connection with an instruction execution system, apparatus, or device, for example, a disk media, computer memory, or other storage device. Non-transitory storage medium does not include a transitory signal. Examples of non-transitory storage medium may include, for example, a computer-readable medium, a computer distribution medium, a computer-readable storage medium, and a computer program.

For example, the computer program product can reside in random access memory (RAM), flash memory, read-only memory (ROM), erasable programmable read-only memory (EPROM), electrically erasable programmable read-only memory (EEPROM), registers, hard disk, a removable disk, a compact disk read-only memory (CD-ROM), or any other form of storage medium known in the art. The storage medium may be coupled to the processor such that the processor can read information from, and write information to, the storage medium. In the alternative, the storage medium may be integral to the processor. The processor and the storage medium can reside in an application specific integrated circuit (ASIC). In the alternative, the processor and the storage medium can reside as discrete components.

The computer program product according to certain embodiments of the invention, may be composed of modules that are in operative communication with one another, and which are designed to pass information or instructions to an electronic device, such as a personal computer, a handheld device, such as a mobile, a cellular telephone, or a personal digital assistant (PDA) having wireless communication capabilities, a portable computer having wireless communication capabilities, and a portable unit or a terminal that incorporates combinations of such functions, as non-limiting examples.

In accordance with an embodiment of the invention, there is provided a computer program product embodied on a non-transitory computer readable storage medium. The computer program product is encoded with instructions to control a processor to perform a process, which includes receiving a request from a first user node to initiate an auction for a purchase of a product, and initiating an auction for the product. The process further includes receiving an initial bid from a second user node. The initial bid includes a price term that is lower than or equal to an initial price term for the product. The process further includes receiving one or more subsequent bids from the second user node or another user node. Each subsequent bid includes a price term that is lower than the price term of the initial bid and a preceding subsequent bid. Furthermore, the process includes terminating the auction, when a period of time lapses or a price point is accepted.

One having ordinary skill in the art will readily understand that the invention as discussed above may be practiced with steps in a different order, and/or with hardware elements in configurations which are different than those which are disclosed. Therefore, although the invention has been described based upon these preferred and non-limiting embodiments, it would be apparent to those of skill in the art that certain modifications, variations, and alternative constructions would be apparent, while remaining in the spirit and scope of the invention. Thus, the example embodiments do not limit the invention to the particular listed devices and technologies. In order to determine the metes and bounds of the invention, therefore, reference should be made to the appended claims.

I claim:

1. A method comprising:

creating by at least one computer processor a linked auction for the between a first product and an at least one other product, wherein the first product is listed in the linked auction for a first price and a second product from the at least one other product is listed in the linked auction for a second price, wherein the first price and second price are different and the first product and second product are different;

receiving a bid for the first product from a first seller;

in response to at least receiving the bid, automatically lowering the first price to a first adjusted first price by a first amount;

in response to at least receiving the bid, automatically lowering the second price to a first adjusted second price by the first amount;

receiving a subsequent bid for the second product, wherein the subsequent bid is received from a second seller who is different from the first seller;

in response to at least receiving the subsequent bid, automatically lowering the first adjusted second price to a second adjusted second price by a second amount;

in response to at least receiving the subsequent bid, automatically lowering the first adjusted first price to a second adjusted first price by the second amount;

determining a winning product for the linked auction.

2. The method of claim 1, wherein the first amount is the bid subtracted from the first price and the second amount is the subsequent bid subtracted from the first adjusted second price.

3. The method of claim 1, wherein the first amount and the second amount are percentages.

4. A system comprising:

at least one computer processor;

at least one memory configured to cause the at least one computer processor to:

create a linked auction between a first product and an at least one other product, wherein the first product is listed in the linked auction for a first price and a second product from the at least one other product is listed in the linked auction for a second price, wherein the first price and second price are different and the first product and second product are different;

receive a bid for the first product from a first seller;

in response to at least receiving the bid, automatically lower the first price to a first adjusted first price by a first amount;

in response to at least receiving the bid, automatically lower the second price to a first adjusted second price by the first amount;

receive a subsequent bid for the second product, wherein the subsequent bid is received from a second seller who is different from the first seller;

in response to at least receiving the subsequent bid, automatically lower the first adjusted second price to a second adjusted second price by a second amount;

in response to at least receiving the subsequent bid, automatically lower the first adjusted first price to a second adjusted first price by the second amount;

determine a winning product for the linked auction.

5. The system of claim 4, wherein the at least one memory is further configured to cause the at least one computer processor to create the first amount by subtracting the bid from the first price and create the second amount by subtracting the subsequent bid from the first adjusted second price.

6. The system of claim 4, wherein the at least one memory is further configured to cause the at least one computer processor to assign percentages to the first amount and the second amount.

7. A non-transitory computer readable medium comprising executable instructions which when executed by at least one computer processor to cause the at least one computer processor to perform the following steps:

create a linked auction between a first product and an at least one other product, wherein the first product is listed in the linked auction for a first price and a second product from the at least one other product is listed in the linked auction for a second price, wherein the first price and second price are different and the first product and second product are different;

receive a bid for the first product from a first seller;

in response to at least receiving the bid, automatically lower the first price to a first adjusted first price by a first amount;

in response to at least receiving the bid, automatically lower the second price to a first adjusted second price by the first amount;

receive a subsequent bid for the second product, wherein the subsequent bid is received from a second seller who is different from the first seller;

in response to at least receiving the subsequent bid, automatically lower the first adjusted second price to a second adjusted second price by a second amount;

in response to at least receiving the subsequent bid, automatically lower the first adjusted first price to a second adjusted first price by the second amount;

determine a winning product for the linked auction.

8. The non-transitory computer readable medium of claim 7, wherein the executable instructions further cause the at least one computer processor to create the first amount by subtracting the bid from the first price and create the second amount by subtracting the subsequent bid from the first adjusted second price.

9. The non-transitory computer readable medium of claim 7, wherein the executable instructions further cause the at least one computer processor to assign percentages to the first amount and the second amount.

* * * * *